US006434751B1

(12) United States Patent
Gustafson et al.

(10) Patent No.: US 6,434,751 B1
(45) Date of Patent: Aug. 20, 2002

(54) NOVELTY TANK TOP

(76) Inventors: Jamie K. Gustafson, 96 Fuller Ave.; Joyce A. Christy, 132 Crestview Blvd.; Stacy A. Kramer, 1014 Spring St., all of Warren, PA (US) 16365; Lynn E. Gustafson, 26241 Lake Shore Dr., Euclid, OH (US) 44132; Jody E. Howe, 4343 Wood Glen, Charlotte, NC (US) 28226

( * ) Notice: Subject to any disclaimer, the term of this patent is extended or adjusted under 35 U.S.C. 154(b) by 0 days.

(21) Appl. No.: 09/985,058

(22) Filed: Nov. 1, 2001

Related U.S. Application Data

(60) Provisional application No. 60/253,935, filed on Nov. 30, 2000.

(51) Int. Cl.[7] ..... A41D 1/04

(52) U.S. Cl. ..... 2/113; 2/400; 2/405; 2/69; 2/115

(58) Field of Search ..... 2/113, 102, 114, 2/243.1, 115, 118, 69, 121, 78.1–78.3, 109, 111, 105, 106, 403, 405, 400; 450/1, 7, 8, 10, 11, 12, 15, 16, 23, 30, 31, 33; D2/700, 701, 703, 706, 707, 708, 711, 712, 716, 717, 731, 734, 829, 840, 844–848, 854, 861, 862, 863, 864

(56) References Cited

U.S. PATENT DOCUMENTS

| | | | | | |
|---|---|---|---|---|---|
| 1,765,003 | A | * | 6/1930 | Caldor | 450/7 |
| 2,416,108 | A | | 2/1947 | Lloyd | |
| D238,116 | S | * | 12/1975 | Firkser | D2/700 |
| 4,440,174 | A | * | 4/1984 | Cordova | 450/7 |
| 4,564,015 | A | * | 1/1986 | Friedman | 450/30 |
| 4,821,343 | A | | 4/1989 | Quealy | |
| D390,337 | S | | 2/1998 | Mixon | |
| 5,842,230 | A | * | 12/1998 | Laudick | 2/69 |
| D406,436 | S | * | 3/1999 | Roszell | D2/737 |
| D419,280 | S | * | 1/2000 | Hines | D2/712 |

* cited by examiner

*Primary Examiner*—Gloria M. Hale
(74) *Attorney, Agent, or Firm*—Richard C. Litman

(57) ABSTRACT

A novelty tank top derived from a man's undergarment. The inverted undergarment is worn over the upper torso of the wearer. The novelty tank top has an anterior pocket for carrying small items and a spandex liner that improves the functionality of the tank top.

6 Claims, 3 Drawing Sheets

NOVELTY TANK TOP

CROSS-REFERENCE TO RELATED APPLICATION

This application claims the benefit of U.S. Provisional Patent Application Serial No. 60/253,935, filed Nov. 30, 2000.

BACKGROUND OF THE INVENTION

1. Field of the Invention

The present invention relates generally to wearing apparel, and more particularly to a novelty tank top having the shape of a man's undergarment.

2. Description of Related Art

Novelty apparel is both attractive and distinctive and reflects the creative imagination of its designers. Even the old can be made new with the creative touch. Novelty apparel is fresh and different. Novelty apparel is eye catching, getting the attention of passers by. Sometimes new designs are created from old designs to create a fresh new look that is both stylish and innovative. New and novel fashions are created from yesterday's styles.

The prior art describes a variety of novelty apparel, for example, an ornamental design for a sleeveless "V" neck shirt is described in U.S. Pat. No. Des. 390,337 issued on Feb. 10, 1998 to R. W. Mixon. U.S. Pat. No. 4,821,343 issued on Apr. 18, 1989 to J. F. Quealy describes upper torso wearing apparel. The upper torso wearing apparel has the appearance of mens' lower underwear which are adapted to be worn in an inverted orientation over the upper torso as a shirt.

None of the above inventions and patents, taken either singly or in combination, is seen to describe the instant invention as claimed.

SUMMARY OF THE INVENTION

Accordingly, it is a principal object of the invention to provide a novelty tank top having a distinction shape and appearance.

It is another object of the invention to provide a novelty tank top that is derived from a man's undergarment.

It is a further object of the invention to provide a novelty tank top that is comfortable to wear.

Still another object of the invention is to provide a novelty tank top that is versatile.

It is an object of the invention to provide improved elements and arrangements thereof in a novelty tank top for the purposes described which is inexpensive, dependable and fully effective in accomplishing its intended purposes.

To meet the above objectives, the present invention provides a novelty tank top that is derived from a mens' pair of underwear. The novelty tank top is an inverted pair of mens' underwear or briefs worn over the upper torso. The novelty tank top of the present invention has an anterior pocket derived from the front fly of the briefs and used to carry small items. A spandex liner increases the versatility and functionality of the tank top by eliminating the need for a woman to wear a bra underneath the tank top, by improving the form fitting capabilities of the tank top, and by making the tank top suitable to wear year-round.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
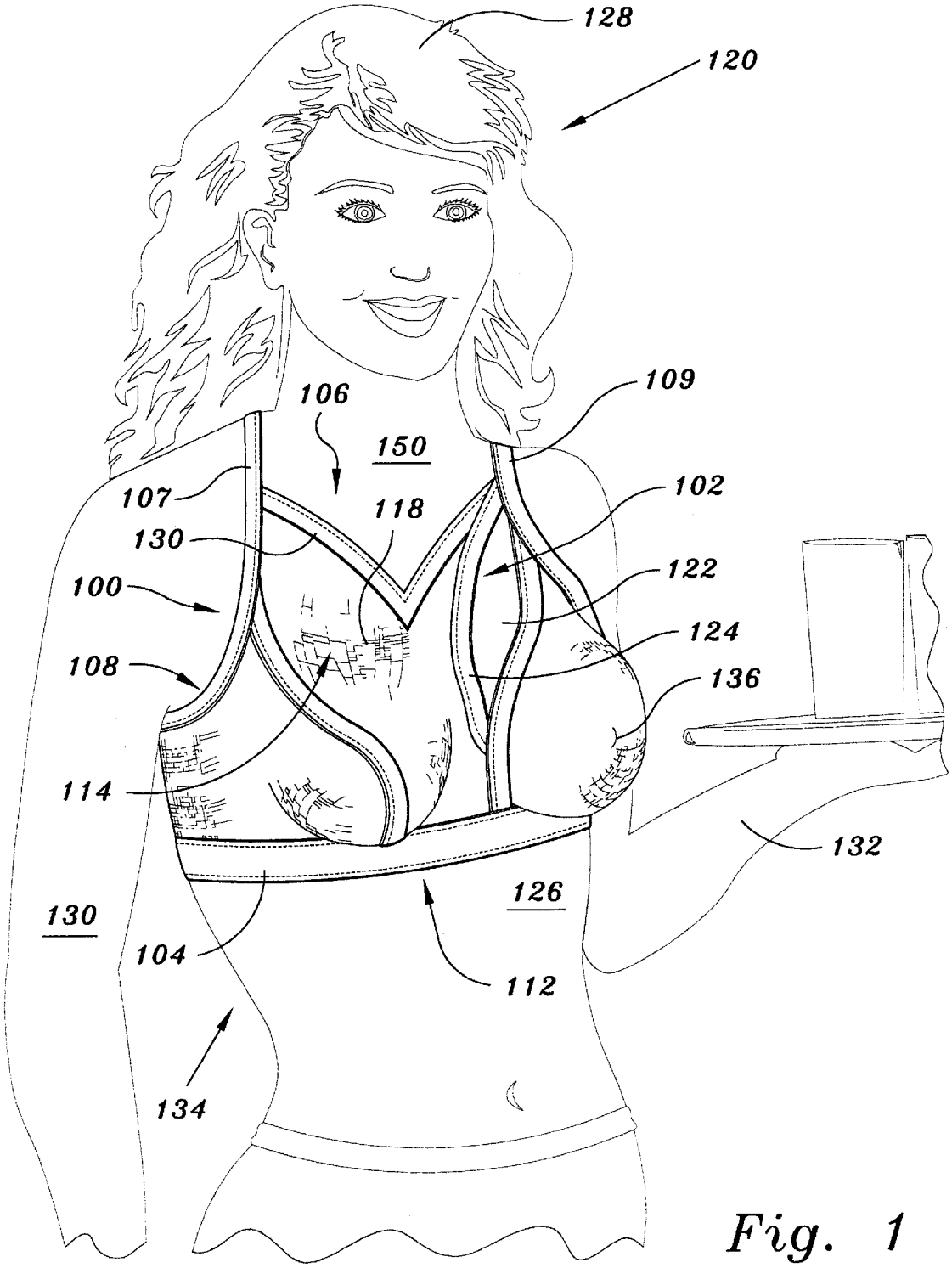
FIG. 1 is an environmental, perspective view of a person wearing a novelty tank top according to the present invention.

The present invention, as depicted in FIGS. 1–4, is a novelty tank top 100 designed to have the appearance of an inverted pair of men's underwear. The tank top 100 resembles the type of men's underwear commonly known as briefs, as opposed to boxer shorts. FIG. 1 is an environmental, front view of a person 120 wearing a novelty tank top 100. The novelty tank top 100 is worn with the front fly 102 of a man's brief on the front of the novelty tank top 100, that is, the front fly 102 is disposed on the chest 118 of the wearer 120 as depicted in FIG. 1. In a preferred embodiment, a pocket 124 is formed by the overlapping front fly 102 and the underpanel 122 that is created naturally by the stretch of the fabric. In an alternate embodiment, the overlapping front fly 102 is stitched to the underlying underpanel 122 to form a closed pocket 124. The inverted front fly 102 makes a convenient pocket 124 into which small items can be kept. This is extremely advantageous because of the tight-fitting nature of tank tops 100 where space for carrying items is at a premium.

The leg openings of the briefs become the arm openings 108,110 of the novelty tank top 100 and the waistband 104 of the briefs 100 fits around the lower portion of the upper torso 126 of the wearer 120. The open neck 106 of the novelty tank top 100 allows the novelty tank top 100 to be worn as a cropped summer tank top 100. The open neck 106 is specifically designed to be comfortable, decrease sweating, and to release body heat when the tank top 100 is worn in warm weather. The front seam 130 of the distinctive open neck 106 has equal seam width between the breastbone (sternum) 150 for a stylish appearance. The novelty tank top 100 has a spandex liner 140 (see FIG. 4) underneath it. The spandex liner 140 has the same shape as the tank top 100 so that the liner is readily concealed beneath the tank top 100.

The spandex liner 140 eliminates the need to wear a bra underneath the tank top 100, making the novelty tank top 100 comfortable to wear and easy to put on or to take off. The liner adds discretion to the novelty tank top 100 such as hiding nipples 136 for those persons not wanting to wear a tank top made of a thin see-through material. The spandex liner 140 also adds the sports support that some people are looking for when exercising in a tank top 100.

Figure 2:
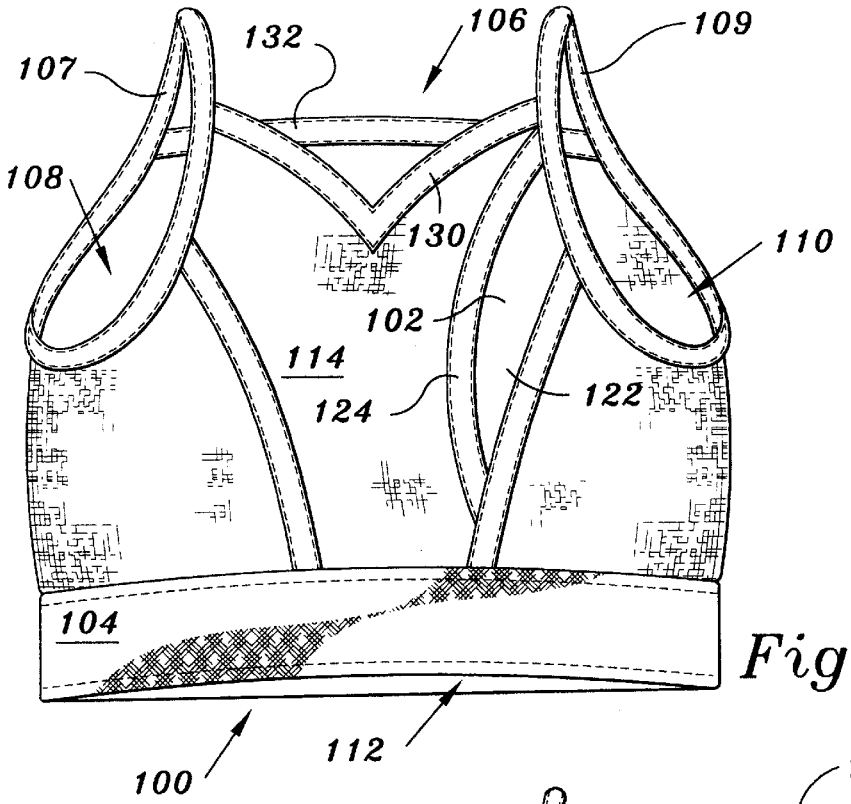
FIG. 2 is a front view of the novelty tank top.
Figure 3:
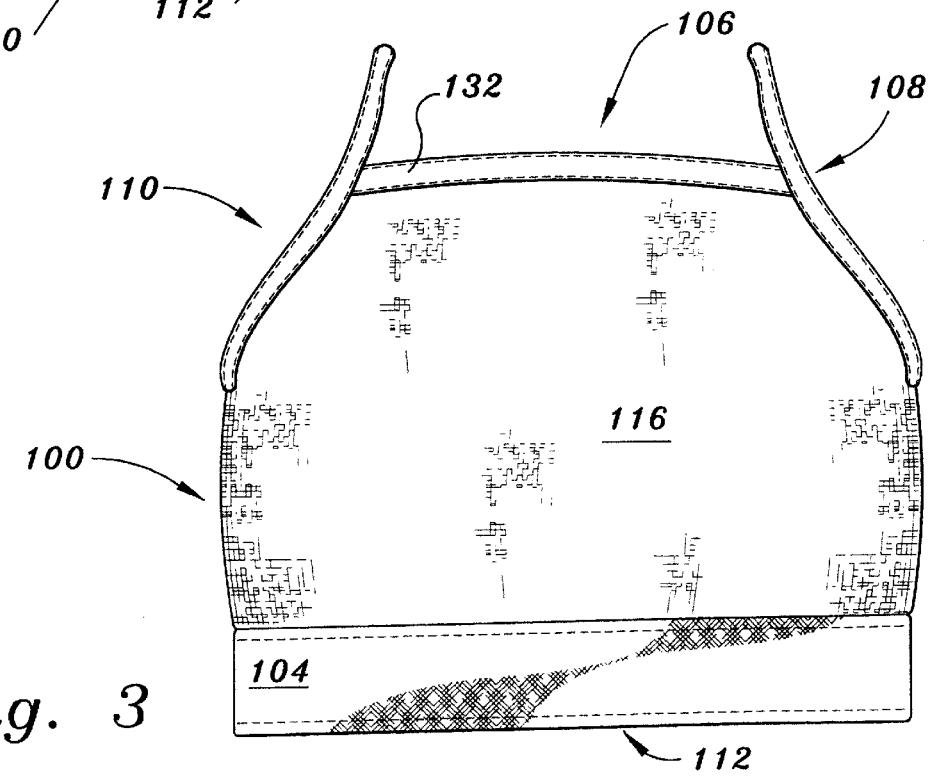
FIG. 3 is a rear view of the novelty tank top.
Figure 4:
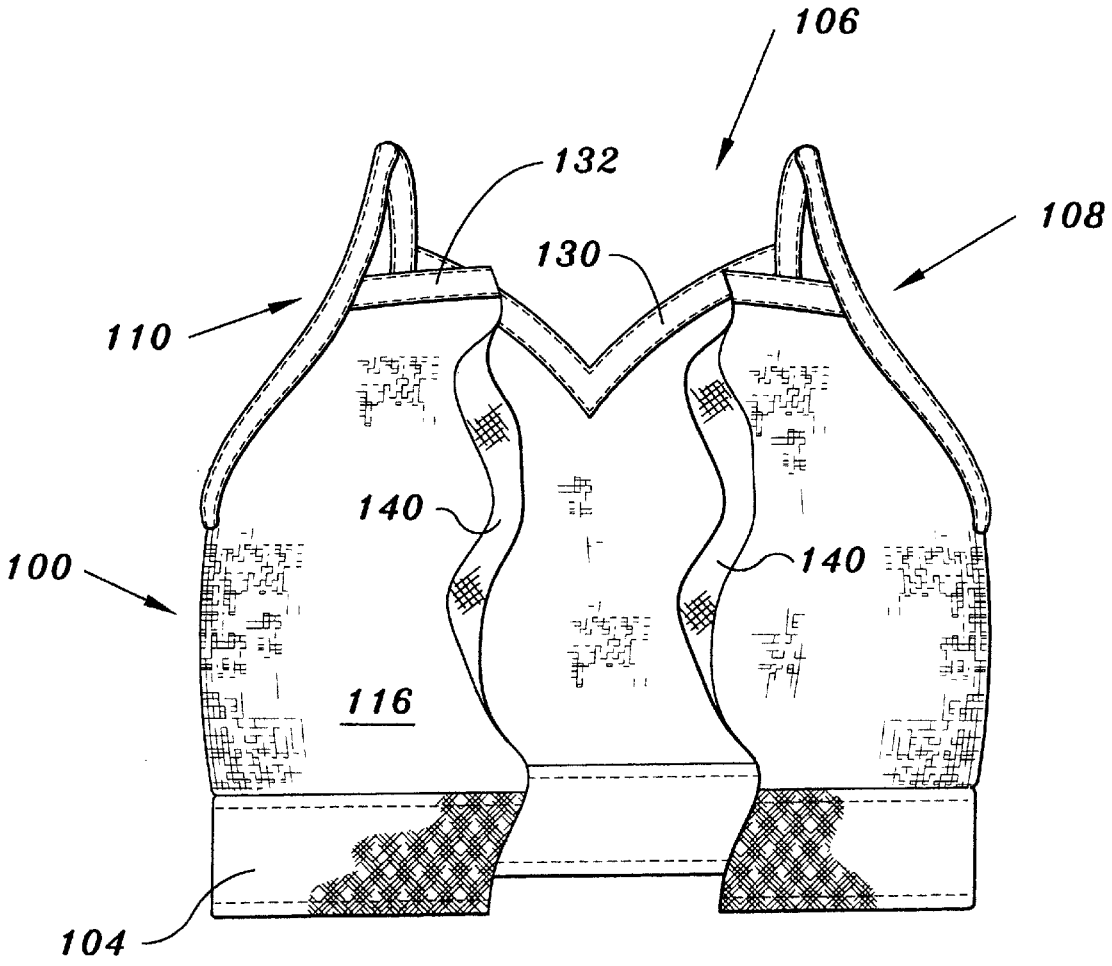
FIG. 4 is a broken away view of the novelty tank top as in FIG. 3, above, showing the spandex liner.

FIG. 2 is a front view of the novelty tank top 100, while FIG. 3 is a rear view of the novelty tank top 100. FIGS. 2 and 3 show that the novelty tank top 100 has the characteristic stitching and hems of male briefs. The rear seam 132 of the open neck 106 rests comfortably against the base of the neck of the wearer 120. The novelty tank top 100 is made of comfortable, flexible cotton or a cotton blend material, however, any suitable material or fabric can be used. The elastic waistband 104 fits snugly around the lower portion of the upper torso 126 of the wearer 120. The open neck 106 is a centrally disposed opening in the crotch area of the brief. The front of the male brief where the front fly 102 is disposed also constitutes the front of the novelty tank top 100.

The novelty tank top 100 is donned by a wearer 120 by placing her head 128 through open neck 106, preferably an open type T-shirt neck such as a "V"-neck, of the tank top 100 and her arms 130,132 through the laterally disposed openings 108,110 having shoulder straps 107 and 109 of the tank top 100 and pulling the form fitting tank top 100 over her upper torso 134 until the elastic waistband 104 of the tank top 100 fits snugly and comfortably around the lower portion of the upper torso 126. The spandex liner 140 may be so fitted in relationship to her upper torso 134 and the outer layer of the tank top as to reveal the physical outline of the genital portion of her breasts including her nipples 136 while retaining sufficient opaqueness so as to avoid direct vision of her nipples 136 in the interest of modesty. The spandex liner 140 improves the fit of the tank top 100 and increases the durability of the tank top 100.

The novelty tank top of the present invention with its spandex liner 140 can be worn by itself or under other clothing. The novelty tank top is highly functional and can be worn year-round, for example, the novelty tank top can be worn as a winter support under the layers of clothes a person normally wears to add warmth. The novelty tank top can accommodate women of any size or shape with its soft cotton exterior and its comfortable form fitting spandex liner.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

We claim:

1. A novelty tank top comprising:

an inverted pair of men's underwear having a body portion including a crotch area, an overlapping front fly, a pair of laterally disposed leg openings and an expandable waistband;

said body portion also including a centrally disposed aperture defined in the crotch area for passing a wearer's head and neck therethrough while passing the wearer's arms through the leg openings and pulling the waistband downward to encircle the upper torso of the wearer;

said body portion having overlying folds corresponding to the front fly to define a pocket; and said body portion further including a liner made of spandex.

2. The novelty tank top according to claim 1, wherein said inverted underwear includes briefs.

3. The novelty tank top according to claim 1, wherein said liner is sewn to said body portion.

4. The novelty tank top according to claim 1, wherein said body portion is made of soft cotton knit material.

5. The novelty tank top according to claim wherein said centrally disposed aperture has a V-shaped front.

6. The novelty tank top according to claim 1, wherein said centrally disposed aperture and said laterally disposed openings form opposing shoulder straps.

* * * * *